US005546724A

United States Patent [19]

Reinklou

[11] Patent Number: 5,546,724

[45] Date of Patent: Aug. 20, 1996

[54] BEAM ANCHORING DEVICE

[75] Inventor: Lars A. Reinklou, Ostersund, Sweden

[73] Assignee: Combisafe International Aktiebolag, Ostersund, Sweden

[21] Appl. No.: 256,969

[22] PCT Filed: Jan. 28, 1993

[86] PCT No.: PCT/SE93/00061

§ 371 Date: Aug. 1, 1994

§ 102(e) Date: Aug. 1, 1994

[87] PCT Pub. No.: WO93/15285

PCT Pub. Date: Aug. 5, 1993

[30] Foreign Application Priority Data

Jan. 30, 1992 [SE] Sweden ..... 9200260

[51] Int. Cl.[6] ..... E04B 1/58; F16B 2/14

[52] U.S. Cl. ..... 52/698; 52/766; 24/522; 248/228.2; 248/231.31

[58] Field of Search ..... 24/459, 522, 526; 52/698, 703, 766, DIG. 8, 729.1; 248/316.2, 228.1, 228.2, 231.31

[56] References Cited

U.S. PATENT DOCUMENTS

| | | | |
|---|---|---|---|
| 166,022 | 7/1875 | Mihills | 24/526 |
| 888,931 | 5/1908 | Robinson | 24/459 X |
| 1,000,389 | 8/1911 | Ette | 248/228 X |
| 1,154,916 | 9/1915 | Evans | 24/459 X |
| 1,506,442 | 8/1924 | O'Hara | 52/766 X |
| 1,571,230 | 2/1926 | Bohn | 52/766 |
| 1,898,725 | 2/1933 | Hamilton | 248/231.3 |
| 2,464,225 | 3/1949 | Graham | 248/228 |
| 2,491,638 | 12/1949 | Ayers | 52/698 X |
| 4,676,687 | 6/1987 | Koffler | 248/228 X |
| 4,700,917 | 10/1987 | Dillman | 248/228 |

*Primary Examiner*—Carl D. Friedman
*Assistant Examiner*—Kevin D. Wilkens
*Attorney, Agent, or Firm*—Young & Thompson

[57] ABSTRACT

A device for anchoring beams, together or to one or more other structural elements. A wedge-shaped beam attachment (10) is intended to straddle respective beams and can be fitted in any selected position along the beam. The attachment includes a short leg (12) and a long leg (14) which define an angle or 90 degrees with one another. An angled collar (16) on the short leg (12) is bent through 90 degrees and the outer end of the long leg (14) is bent to an angle of about 75 degrees. This bent outer end of the long leg (14) forms an abutment spring (18) which consequently defines an angle of approximately 75 degrees with the long leg (14) and which functions to urge a wedge (23) resiliently against the side edge of a beam.

3 Claims, 2 Drawing Sheets

BEAM ANCHORING DEVICE

The present invention relates to a device for beam anchoring.

Different types of beams are used as load-bearing devices in building and construction work. The traditional I-beam is perhaps the most common beam used in this respect. In the construction of a building, for instance, it is often necessary to anchor different auxiliaries to such beams for a longer or shorter period of time, in order to facilitate building work or to join together various building elements or structural elements which include a profiled beam section or the like. Hitherto, this has been effected, particularly in the case of wooden beams, by nailing the building element concerned to the beams, or by drilling holes and securing said building element with the aid of nuts and bolts. These anchoring methods are relatively time-consuming and the building elements thus anchored cannot be readily released or removed when their functional task has been completed. Moreover, the strength of the join thus obtained is determined arbitrarily, for instance depending on how and where the nails are driven into the beams or where and how the bolts are positioned, and the forces acting in the joins are transferred in a punctiform fashion in the interface between the elements. It is, therefore, desirable to improve the aforesaid anchoring methods with the aid of an anchorage device which can be handled simply, which is cheap to manufacture and which can be quickly anchored to and removed from a load-bearing construction element, for instance an I-beam.

The object of the invention is therefore to provide a device of the aforesaid kind which has properties that will eliminate the aforesaid drawbacks.

This object is achieved with a device of the kind defined thereafter.

Thus, the inventive beam anchorage device is a wedge-shaped beam attachment which can be fitted to, i.e. anchored to and removed from, the flanges of an I-beam at any chosen position therealong, said beam including, for instance, elongated wooden elements. The beam need not be provided with any separate attachment point in the form of a machined location, attachment hole, attachment element or any particularly configured part. Depending on the area of use, the building or structural element to be anchored to the beam is firmly screwed, welded or in some other known manner attached to the outer surface of the beam attachment, which is configured to provide an optimum grip around the edge or edges of the beam. This grip is achieved by virtue of the fact that the attachment is bent from metal sheet, preferably steel plate, suitably surface-treated against corrosion, such as to form a first and a second leg which extend at right angles to one another. The outer extremities of respective legs are bent to a predetermined angle. The second leg is provided with a slot which extends generally at right angles from the outer edge of the leg to roughly the midway point of said leg, said slot being located in the centre part of the attachment. Mounted in the slot is a locking device which can move freely between two limit positions determined by stop means mounted at respective ends of the device.

When fitting the attachment, or anchoring device, the locking device is pressed against one edge of a beam to which the attachment shall be fitted and also to the outer edge of the bent leg. Depending on the configuration of the locking device, the length of the bent outer edge and the predetermined value of the angle of the bend, when the attachment is fitted, the pressure forces will act at different angles on different parts of the upper flange of the beam. In this regard, an advantage is afforded when the pressure force is directed in towards the join line between the legs and thus defines an angle which is greater than zero degrees in relation to the other leg. The point of engagement with the edge of the beam flange is preferably located at a distance from the upper surface of the beam which is greater than half the thickness of the flange.

A preferred embodiment of the invention will now be described in more detail with reference to the accompanying drawings, in which FIG. 1 is a perspective view of a wedge-shaped beam attachment seen from above and from one short end of the attachment;

Like elements are identified by like reference numerals in the various Figures.

Figure 1:
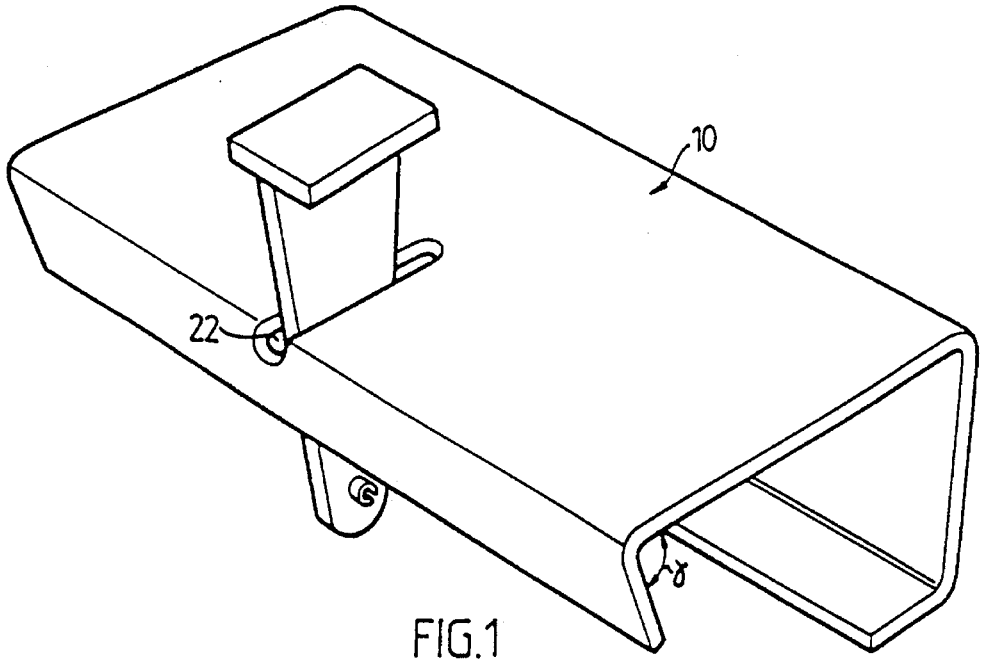
Figure 2:
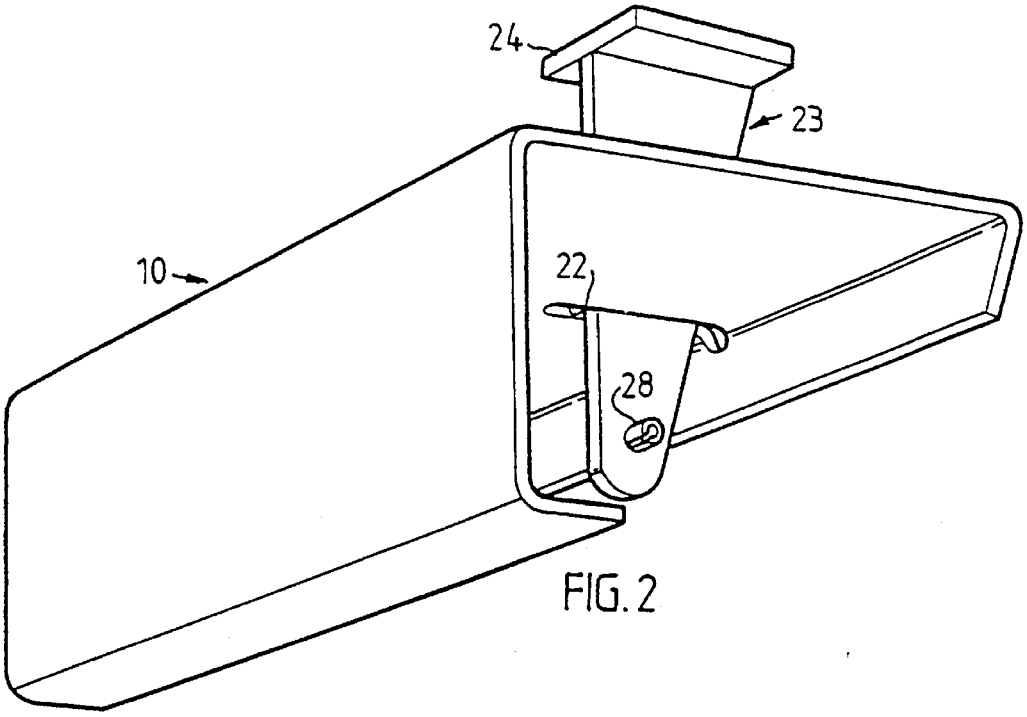
FIG. 2 is a perspective view of the beam attachment as seen obliquely from beneath and from the other short end of the attachment.
Figure 3:
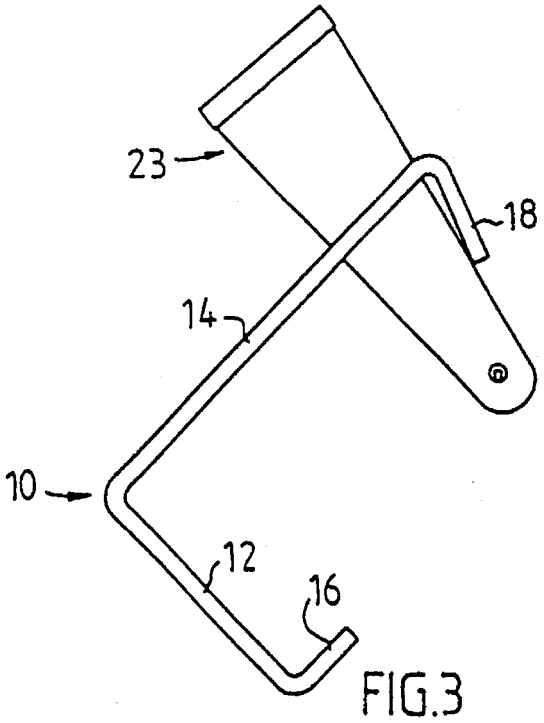
FIG. 3A is a sectional view of a beam onto which the beam attachment shall be anchored, and FIG. 3 also shows the beam attachment.
Figure 3A:
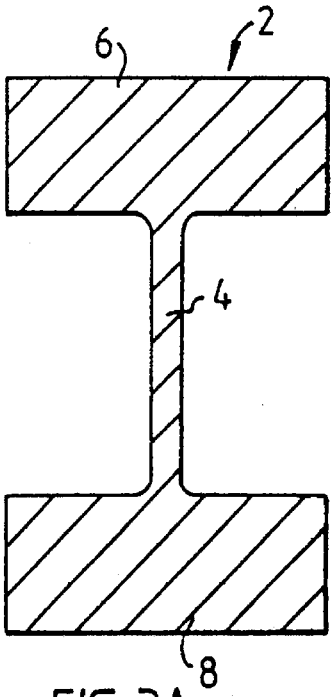
Figure 4:
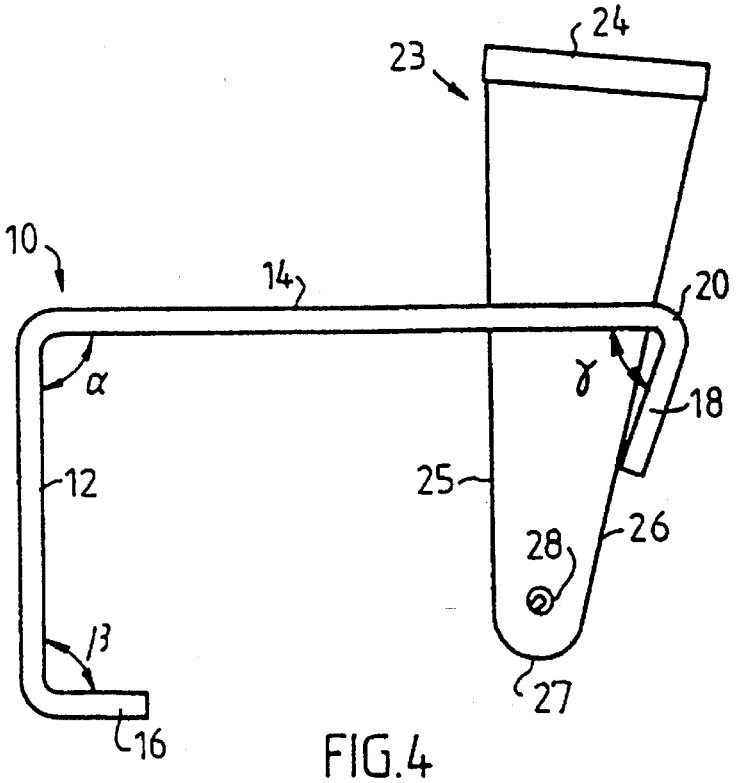
FIG. 4 is a vertical view of the beam attachment as seen from one short end thereof.

The drawings illustrate a beam anchoring device in the form of a wedge-shaped beam attachment 10 which is intended to be anchored onto an I-beam 2 comprising a web 4, an upper flange 6 and a lower flange 8. As will best be seen from FIG. 4, the beam attachment includes a short first leg 12 and a long, second leg 14, said legs being mutually joined to define an angle $\alpha$ therebetween. Each of the outer extremities of the legs is bent to a respective predetermined angle $\beta$ and $\gamma$ thereby to form an angled collar 16 and an abutment spring 18 respectively. The angle $\alpha$ and the angle $\beta$ are preferably 90 degrees, whereas the angle $\gamma$ will preferably have values within the range of 70 to 75 degrees.

This configuration results in a rounded knee 20 on the outer end of the leg 14. A slot 22 extends generally at right angles from the knee 20 to roughly midway along the leg and, seen transversely , is located in the centre part of the leg 14. The slot is configured so that a locking device in the form of a wedge 23 is able to move freely therealong between two limit positions. The wedge includes a hammer plate 24, two side edges 25, 26, a wedge tip or apex 27 and a locking pin 20. The limit positions are determined in one direction by the hammer plate 24 and in the other direction by the locking pin 28. The edges 25 and 26 of the wedge, the hammer plate 24 and the wedge apex 27 define therebetween two mutually parallel, flat side surfaces. The hammer plate 24 is preferably arranged at right angles to the side surfaces, and the two side edges are also preferably arranged at right angles to the side surfaces and converge mutually in a direction away from the hammer plate 24 and towards the wedge apex 27. The converging angle assumes values of between 12 to 14 degrees. The locking pin 28 projects through the apex 27 defining the parallel side sur-faces, essentially at right angles thereto, through a predetermined distance on both sides of the wedge apex, which is given an arcuate, preferably circular-arcuate transition between the two side edges 25 and 26.

When fitting the attachment, the short leg 12 provided with the angled collar 16 is first fitted over one side edge of the beam flange 6. The attachment is then positioned so that the long leg will abut parallel with the outer surface of the flange 6. Subsequent to having fitted the attachment in position on the beam, the wedge 23 is driven down so as to be pressed against the other side edge of the flange and to be guided in towards said edge as a result of the spring action of the abutment spring 18. Due to the structural configuration of the wedge and the abutment spring, the pressure force will act on the edge bordering the under surface of the flange and is directed obliquely upwards towards the long leg 14. In this way, the wedge and the abutment spring will act as a second, releasable angled collar and therewith lock the attachment firmly to said edge. The spring properties of the abutment spring 18 ensure that the attachment is firmly locked without needing to adjust the attachment, even if changes in dimension occur with time, for instance in the case of a wooden beam. When wishing to remove the attachment, the wedge is loosened by driving the wedge upwards, e.g. by hammering the plate 24 from beneath with the aid of a suitable tool, or by gripping the plate and drawing the wedge upwards, for instance with the aid of a crowbar, carpenter's hammer or like clawed tool.

It will be understood that the present invention is not restricted to the aforedescribed exemplifying embodiment thereof, and that the invention includes all the embodiments and equivalent solutions that lie within the scope of the following claims.

I claim:

1. In a device for anchoring beams, to one another or to other structural elements, comprising a beam attachment which has a generally U-shaped configuration so as to be able to stradle a beam when fitted thereon, and which attachment includes a first leg, a second leg and an angled collar, said legs extending generally at right angles ($\alpha$) to one another and the outer extremities of each of said legs being bent at a respective predetermined angle $\beta$ and $\gamma$; the improvement wherein the angled collar (16) is formed on the first leg (12) and a locking device (23) is mounted in a slot (22) in the second leg (14); the locking device (23) being movable through the slot between the first leg (12) and the outer end (18) of said second leg (14), the side of said locking device (23) opposite said first leg (12) being in contact only with the endmost portion of said outer end (18) of said second leg (14), whereby said outer end (18) of said second leg (14) serves as an abutment spring to urge said locking device (23) toward said first leg (12), wherein the locking device is a wedge (23) whose side edges (25, 26) converge towards one another in the direction that said first leg (12) extends away from said second leg (14), and wherein said wedge has a hammer plate (24) at its wider end and stop means (28) at its narrower end to keep the wedge in the slot (22).

2. A device according to claim 1, wherein the converging angle of said side edges (25, 26) is 10 to 15 degrees.

3. A device according to claim 1, wherein the angle $\beta$ is 90 degrees and the angle $\gamma$ is 65–80 degrees.

* * * * *